US005480226A

United States Patent [19]

Milstead

[11] Patent Number: 5,480,226

[45] Date of Patent: Jan. 2, 1996

[54] ROTARY DRUM DRYER HAVING AGGREGATE COOLED SHIELDING FLIGHTS AND METHOD FOR THE UTILIZATION THEREOF

[75] Inventor: John Milstead, Chattanooga, Tenn.

[73] Assignee: Astec Industries, Inc., Chattanooga, Tenn.

[21] Appl. No.: 239,767

[22] Filed: May 9, 1994

[51] Int. Cl.[6] ..... B28C 5/46; F27B 7/16; F27B 7/38

[52] U.S. Cl. ..... 366/7; 366/25; 366/228; 34/137; 432/116; 432/118

[58] Field of Search ..... 366/22–25, 57, 366/58, 225, 228, 229, 7; 34/135–137; 432/110, 116, 118, 111

[56] References Cited

U.S. PATENT DOCUMENTS

| | | | |
|---|---|---|---|
| 856,770 | 6/1907 | Cummer | 34/135 |
| 876,440 | 1/1908 | Cummer | 34/135 |
| 888,475 | 5/1908 | Cummer | 34/135 |
| 1,061,762 | 5/1913 | Lierfeld | 366/229 X |
| 1,196,376 | 8/1916 | Meyer | 366/229 |
| 4,189,300 | 2/1980 | Butler . | |
| 4,193,208 | 3/1980 | Ronning | 366/225 X |
| 4,318,620 | 3/1982 | Malipier et al. . | |
| 4,338,732 | 7/1982 | Coxhill | 34/135 |
| 4,422,848 | 12/1983 | Musil | 432/118 |
| 4,867,572 | 9/1989 | Brock et al. | 366/25 |
| 5,052,810 | 10/1991 | Brock | 366/25 |
| 5,203,693 | 4/1993 | Swanson . | |

FOREIGN PATENT DOCUMENTS

| | | |
|---|---|---|
| 0340462 | 11/1989 | European Pat. Off. . |
| 2441682 | 11/1978 | France . |

*Primary Examiner*—Charles E. Cooley
*Attorney, Agent, or Firm*—Nilles & Nilles

[57] ABSTRACT

A rotary drum dryer has devices for cooling shielding flights located in the combustion zone of the drum. The devices comprise cooling flights which rotate with the drum to scoop up relatively small amounts of virgin aggregate from aggregate accumulated in the lower portion of the drum and to shower this aggregate over the outer radial surface of the shielding flights upon further rotation of the drum, thereby cooling the shielding flights without substantially decreasing the mean temperature of the aggregate. Cooling efficiency is enhanced by the continuous cascading of fresh aggregate over the shielding flights from the cooling flights through a substantial portion of the drum's rotation. The cooling flights and shielding flights preferably cooperate to limit or even prevent the showering of materials into the burner flame and thus inhibit burner flame quenching and accompanying emissions. Particularly preferred cooling flights take the form of auxiliary flights which can be easily adapted to existing shielding flight designs.

20 Claims, 2 Drawing Sheets

ROTARY DRUM DRYER HAVING AGGREGATE COOLED SHIELDING FLIGHTS AND METHOD FOR THE UTILIZATION THEREOF

BACKGROUND OF THE INVENTION

1. Field of the Invention

The invention relates to rotary drum dryers having shielding flights which are located in the combustion zone of the drum and which in use shield the drum shell from radiant heat from the burner flame supplying heat to the drum and, more particularly, relates to a method and apparatus for cooling such shielding flights using materials in the drum.

2. Discussion of the Related Art

Many asphalt production plants include a rotary drum dryer in which virgin aggregate is heated and dried and then mixed with liquid asphalt. Such dryers typically comprise a rotating drum which is inclined with respect to the horizontal and which has a virgin aggregate inlet in the upper end thereof and a virgin aggregate outlet in the lower end thereof. A burner is mounted adjacent one of the ends so as to direct a flame generally axially into the drum for heating and drying the aggregate flowing therethrough. The burner may be mounted either on the lower end of the drum, thereby producing a counterflow dryer, or on the upper end of the drum, thereby producing a parallel flow dryer. In addition, a fixed sleeve may be mounted around the outlet end of the drum to define a mixing chamber in which the heated and dried aggregate may be mixed with recycled asphalt product (RAP), liquid asphalt, or the like. The combination of such a rotary drum and a fixed sleeve is commonly known as a dryer drum coater or a drum mixer.

Rotary drum dryers of the type described above, whether used in asphalt production plants or in soil remediation or other plants, are functionally separated into a combustion zone located in the vicinity of the burner flame and a drying zone extending from the combustion zone to the remote end of the drum. Shielding is required around the inner periphery of the combustion zone to prevent the intense heat radiating from the burner flame from damaging the shell of the drum. This shielding was traditionally performed by a refractory liner. More recently, however, this shielding has been performed by shielding flights mounted around the inner periphery of the combustion zone of the drum such that the flights shield the drum shell from radiant heat from the burner flame, thereby obviating the need for a refractory liner. The flights are typically tee shaped and include a shielding member extending generally parallel to the adjacent portion of the drum shell and a post extending radially from the shielding member to the drum shell. Examples of rotary drum dryers having such flights are disclosed in U.S. Pat. Nos. 4,189,300 to Butler (the Butler patent) and 5,203,693 to Swanson (the Swanson patent).

Since the shielding flights are exposed to the radiant heat of the burner flame in the combustion zone, the flights become overheated and rapidly deteriorate and must be frequently maintained or replaced, thus requiring significant undesired downtime. Attempts have been made to alleviate this problem by providing devices to cool the flights using the aggregate in the drum.

For instance, the system proposed in the Butler patent employs shielding flights having radially outwardly projecting legs defining pockets between the radial outer surface of the flights and the shell of the drum. The pockets scoop up aggregate as the flights traverse the lower portion of the drum and hold the aggregate on the flights through much of the drum rotation such that the retained aggregate receives heat from the flights to cool the flights. This cooling is, however, limited because aggregate is for the most part held on the flights rather than cascading over the flights. Essentially the same portions of aggregate thus receive heat from the flights through substantially the entire cooling cycle and thus themselves tend to become overheated. Moreover, although the radially projecting legs defining the pockets are designed to inhibit the showering of materials into the burner flame, a significant amount of such showering may nevertheless occur, thus at least partially quenching the burner flame and decreasing burner efficiency and resulting in undesired emissions.

The process disclosed in the Swanson patent employs specially shaped shielding flights each having a radially outwardly angled leading edge and a radially inwardly angled trailing edge. The inwardly angled leading edges dig into the aggregate and cause the flights to be covered by aggregate as they rotate through the bottom portion of the drum. The inwardly angled trailing edges retain aggregate for a limited time as the flights rotate beyond the bottom portion of the drum; they then direct the retained aggregate back onto the aggregate accumulated in the lower portion of the drum before it can be lifted into the burner flame, thus cooling the flights without significantly quenching the burner flame. The cooling provided by this process is, however, necessarily limited by the limited angle of rotation through which it occurs.

OBJECTS AND SUMMARY OF THE INVENTION

It is therefore an object of the invention to provide a rotary drum dryer for asphalt aggregate or the like employing shielding flights in the combustion zone thereof and having devices for effectively cooling the shielding flights using materials in the drum.

Another object of the invention is to provide a rotary drum dryer of the type described above, the cooling devices of which operate without significantly cooling materials in the drum.

Another object of the invention is to provide a rotary drum dryer of the type described above, the cooling devices of which can be easily adapted for use with existing flight designs, thereby facilitating assembly.

In accordance with these and other aspects of the invention, these objects are achieved by providing a dryer comprising a rotary drum having a cylindrical shell, a burner directing a flame generally axially into the drum to define a combustion zone therein, and a system of flights positioned in the combustion zone. The system of flights includes a plurality of relatively large shielding flights mounted around an inner periphery of the cylindrical shell, and a plurality of relatively small cooling flights. The cooling flights are mounted around the inner periphery of the cylindrical shell radially between the shielding flights and the inner shell and are adapted to shower relatively small amounts of material onto outer radial surfaces of adjacent shielding flights upon rotation of the drum to cool the shielding flights.

In order to promote self-cooling while avoiding flame quenching, each of the shielding flights preferably has an outwardly angled leading edge portion and a medial portion extending generally parallel to an adjacent portion of the shell. In this case, each of the shielding flights should further comprise an inwardly angled trailing edge portion; and the leading edge portion, medial portion, and trailing edge portion should have transverse widths of 3 inches, 6 inches, and 3 inches, accordingly.

Preferably, each of the cooling flights has a leading radial edge positioned in general radial alignment with a leading edge of the medial portion of an adjacent one of the shielding flights. Each of the cooling flights is also preferably dimensioned so as to (1) define a cup for temporarily holding materials during rotation of the cooling flights with the drum and (2) shower materials onto an adjacent shielding flight through a designated angle of rotation. To this end, each of the cooling flights preferably has a relatively short leading radial edge portion, a relatively long trailing radial edge portion, and a medial portion connected to inner radial ends of the leading edge portion and the trailing edge portion, the medial portion extending generally parallel to an adjacent portion of the shell.

Still another object of the invention is to provide a method of effectively cooling shielding flights of a rotary dryer drum.

Yet another object of the invention is to provide a method of the type described above without unnecessarily cooling at least most of the aggregate in the drum.

In accordance with another aspect of the invention, these objects are achieved by providing a method comprising directing a flame axially into a rotating drum to define a combustion zone therein, heating and drying materials in the rotating drum using heat from the flame, and shielding a portion of a shell of the rotating drum which surrounds the combustion zone from heat from the flame. The shielding step comprises positioning shielding flights radially between the flame and the portion of the shell, the flights being attached to and rotating with the drum. The inventive cooling step comprises lifting relatively small amounts of materials from materials accumulated in a lower portion of the drum and continuously showering lifted materials onto outer radial surfaces of the shielding flights through a designated angle of drum rotation such that the showering materials cascade transversely across and off from the shielding flights.

Preferably, the lifting and showering steps are performed by cooling flights attached to the drum radially between the shielding flights and the shell. The showering step preferably occurs through an angle beginning at approximately 90° after bottom dead center and terminating at approximately 270° after bottom dead center.

Yet another object of the invention is to provide a method of the type described above which does not result in significant quenching of the burner flame.

This object is achieved by providing a method exhibiting one or more of the characteristics detailed above and further comprising directing at least most of the cascaded materials back into the lower portion of the drum without contacting the flame.

Other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

1. Resume

Pursuant to the invention, a rotary drum dryer is provided having devices for cooling shielding flights located in the combustion zone of the drum. The devices comprise cooling flights which rotate with the drum to scoop up relatively small amounts of materials such as virgin aggregate from aggregate accumulated in the lower portion of the drum and to shower this aggregate over the outer radial surface of the shielding flights upon further rotation of the drum, thereby cooling the shielding flights without substantially decreasing the mean temperature of the aggregate. Cooling efficiency is enhanced by the continuous cascading of fresh aggregate over the shielding flights from the cooling flights through a substantial portion of the drum's rotation. The cooling flights and shielding flights preferably cooperate to limit or even prevent the showering of materials into the burner flame and thus inhibit burner flame quenching and accompanying emissions. Particularly preferred cooling flights take the form of auxiliary flights which can be easily adapted to existing shielding flight designs.

2. System Overview

Figure 1:
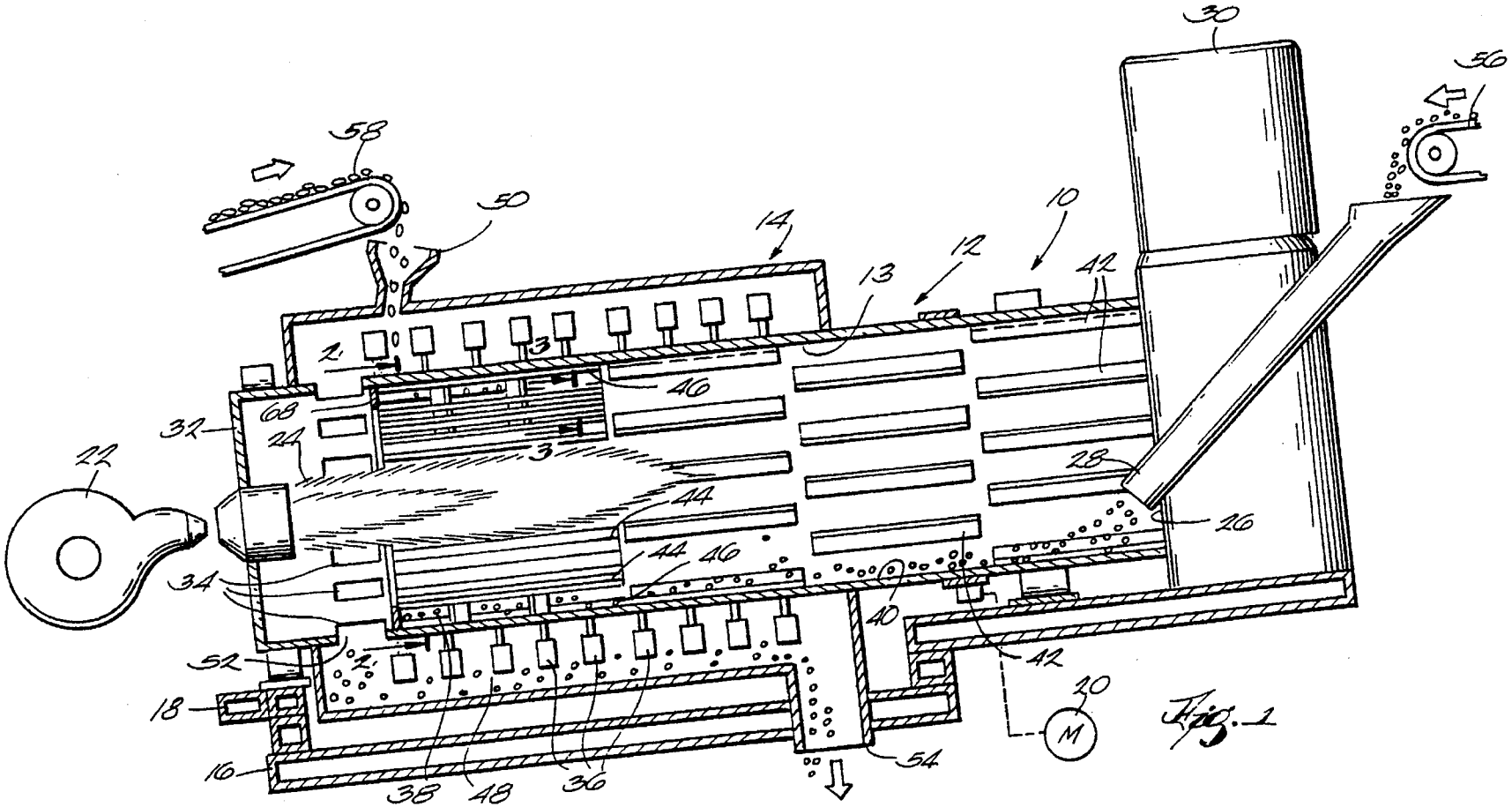
FIG. 1 is a sectional side elevation view of a dryer drum coater having a rotary dryer drum constructed in accordance with the present invention.
Figure 2:
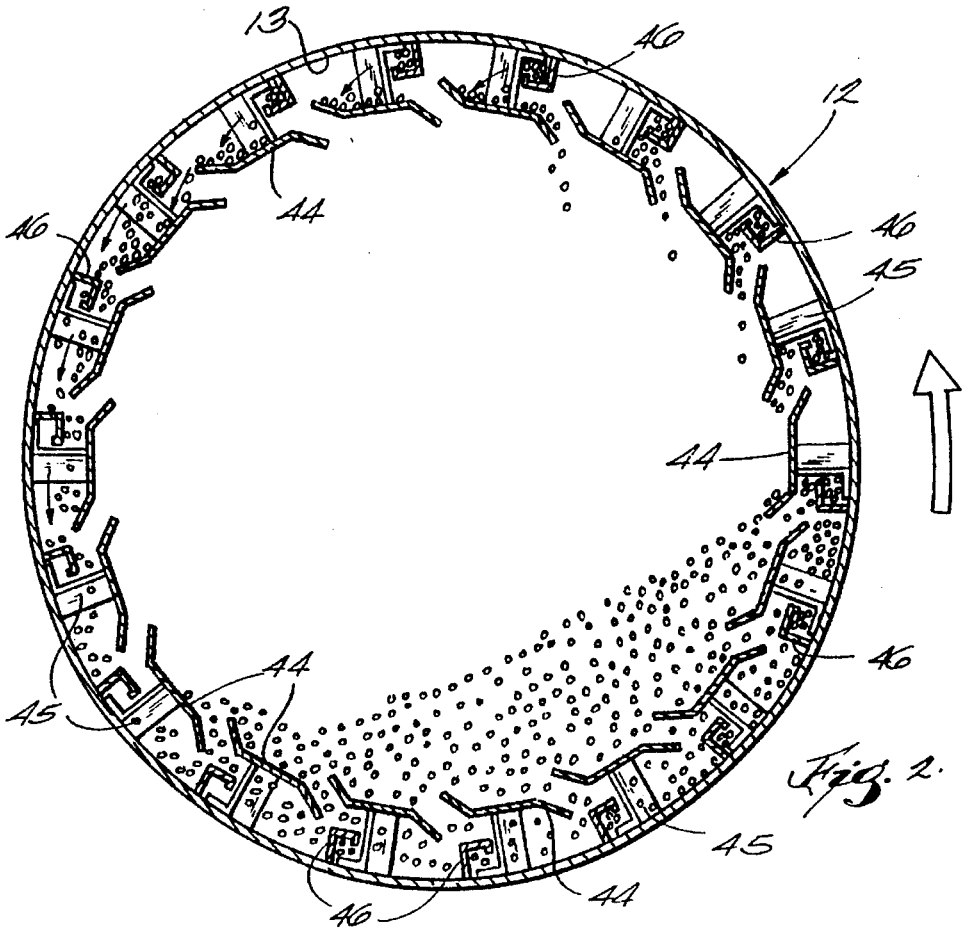
FIG. 2 is a sectional view taken along the lines 2—2 in FIG. 1.
Figure 3:
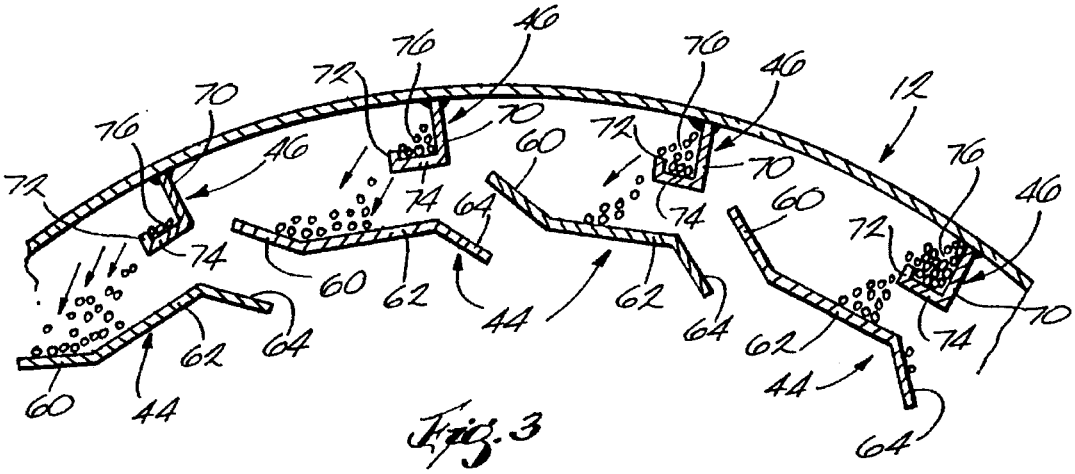
FIG. 3 is a sectional view taken along the lines 3—3 in FIG. 1.

Referring now to FIGS. 1–3, a rotary dryer drum 12 having the inventive shielding flight cooling devices is illustrated in conjunction with a dryer drum coater 10 of the type disclosed in the above described Swanson patent, but is usable in any parallel flow or counterflow rotary drum dryer. The dryer drum coater 10 comprises the inner rotary drum dryer 12 and a fixed outer sleeve 14 mounted on a common frame 16 in an inclined manner. The rotary drum dryer 12 is rotatably mounted on the frame 16 by a plurality of bearings 18 and is driven to rotate by a suitable motor 20. A burner 22 directs a flame 24 generally axially into the interior of rotary drum dryer 12.

Rotary drum dryer 12 is approximately 30–50 feet long and has a diameter of about 6 feet. Rotary drum dryer 12 has at its first (upper) end 26 a virgin aggregate inlet 28 and a combustion products outlet 30, and has at its second (lower) end 32 a plurality of openings 34 forming heated and dried virgin aggregate outlets. Rotary drum dryer 12 also supports a plurality of paddles 36 extending into a mixing chamber 48 formed between the rotary drum dryer 12 and the outer sleeve 14. The interior of the rotary drum dryer 12 is functionally separated into a combustion zone 38 located in the vicinity of the burner flame 24 and a drying zone 40 located between the combustion zone 38 and the first end 26 of the drum 12. A plurality of lifting flights 42 of conventional design are mounted on the inner periphery of the shell 13 of the drum 12 in the drying zone 40 for lifting aggregate and for dropping the aggregate through the interior of the dryer drum 12 as it is rotated. Positioned in the combustion zone 38 of the dryer drum 12 are a plurality of shielding flights 44 and a like plurality of cooling flights 46 the construction and operation of which will be detailed below.

Outer sleeve 14 is separated from the rotary drum dryer 12 by a sufficient distance to form a mixing chamber 48 which is sufficiently wide to provide clearance for the paddles 36. Outer sleeve 14 has an upper recycled asphalt product (RAP) inlet 50, a virgin aggregate inlet 52 cooperating with the openings 34 of the rotary drum dryer 12, and an asphalt mix outlet 54. Outer sleeve 14 is a fixed sleeve encircling at least a portion of a cylindrical shell of the rotary drum dryer 12. Outer sleeve 14 also receives suitable equipment (not shown) for injecting liquid asphalt into the mixing chamber 48.

In use, virgin aggregate is fed into the virgin aggregate inlet 28 of the rotary drum dryer 12 via a suitable conveyor 56 and is heated and dried as it travels downwardly through the inclined drum 12 counter to the direction of the flame 24 from the burner 22. Heated and dried aggregate in the second end 32 of the drum 12 falls through openings 34 in the drum 12, through the inlet 50 in the sleeve 14, and into the mixing chamber 48. RAP is simultaneously fed into mixing chamber 48 from the inlet 50 by a suitable conveyor 58 and is mixed by the paddles 36 with the heated and dried virgin aggregate. Liquid asphalt is also normally injected at this time, thereby forming an asphalt paving mix. In addition to mixing the virgin aggregate, RAP, and liquid asphalt, the paddles 36 also convey the resulting mix to the mixing chamber outlet 54, where the mix is discharged from the dryer drum coater 10. Combustion products formed during operation of the dryer drum coater 10 rise out of the rotary drum dryer 12 through outlet 30 and are conveyed to a downstream device such as a bag house.

The dryer drum coater 10 including the rotary drum dryer 12 and outer sleeve 14 but excluding the combination of the shielding flights 44 and the cooling flights 46 as thus far described is, per se, well known and will not be described in further detail.

The shielding flights 44 and cooling flights 46 interact to shield the drum shell 13 from radiant heat from the burner flame 241 while at the same time: (1) avoiding excess cooling of aggregate in the combustion zone 38, (2) effectively cooling and thus prolonging the life of the shielding flights 44, and (3) inhibiting or even preventing burner flame quenching. Particularly preferred flights and associated devices will now be described.

3. Construction of Shielding Flights and Cooling Flights

Referring now to the drawings and to FIGS. 2 and 3 in particular, the shielding flights 44 could take any form but preferably are of the type described in the above-mentioned Swanson patent 5,203,693. The shielding flights 44 should extend far enough through the dryer drum 12 to assure adequate shielding through the combustion zone 38 and will typically extend about seven to eleven feet through a thirty to fifty foot dryer 12. Flights 44 are connected to the drum shell 13 by posts 45 spaced longitudinally along the flights 44 and are equally spaced about the entire circumference of the inner periphery of the shell 13 of the drum 12. Shielding flights 44 should be positioned sufficiently close to each other so that the inner surface of the shell 13 is substantially completely shielded from the radiant heat from the flame 24 in the combustion zone 38. In practice, the flights 44 are spaced from one another by a center-to-center distance of about 12½ inches, requiring 18 such flights in a drum having a diameter of six feet.

Referring especially to FIG. 3, each of the flights 44 is formed from heat resistant steel and includes a radially outwardly-angled leading edge portion 60, a medial portion 62 extending generally parallel to the adjacent portion of the dryer drum shell 13, and a radially inwardly-angled trailing edge portion 64. In the illustrated embodiment, the medial portion 62 has a transverse width of about 6 inches and each of the leading and trailing edge portions 60, 64 has a transverse width of about half that of the medial portion 62, i.e., about 3 inches. The leading edge portion 60 extends outwardly toward the shell 13 of the drum 12 at an angle of about 30° from the plane of the medial portion 62, and the trailing edge portion 64 extends inwardly from the plane of the medial portion 62 at an angle of about 70°. The medial portion 62 is spaced radially from the drum shell 13 by about 5 inches.

In order to facilitate the accumulation of aggregate in the bottom of the drum 12, a dam 68 (FIG. 1) may be provided at the front end of the combustion zone 38 adjacent the virgin aggregate outlets 34. The dam 68 preferably comprises a plurality of aligned and interconnected metal plates and defines an inside circumferential edge which is spaced from the shell 13 of the drum 12 so as to be coaxial with the medial portion 62 of the flights 44.

Each of the cooling flights 46 is designed to scoop up relatively small amounts of accumulated aggregate from the bottom of the drum 12 and to shower this aggregate onto adjacent shielding flights 44 upon further rotation of the drum 12, thereby cooling the shielding flights 44. The cooling flights 46 are also designed to be used with existing shielding flight designs and to be easily mounted in the dryer drum 12. To this end, the cooling flights 46 are coextensive with the shielding flights 44 and each is connected to the inner surface of the shell 13 of the dryer drum 12 radially between a respective one of the shielding flights 44 and the dryer drum shell 13. Each of the cooling flights 46 is formed from ¼ inch thick heat resistant steel and has a relatively long trailing edge portion 70 welded or otherwise affixed to the dryer drum shell 13 and extending radially from the shell, and a relatively short leading radial edge portion, 72 positioned in general radial alignment with the medial portion 62 of an adjacent shielding flight 44 to define a spout for showering aggregate onto the flights 44. Each flight 46 further includes transverse medial portion 74 connected to the inner radial ends of the leading edge portion 70 and the trailing edge portion 72 to define a cup 76 between the edge portions 70 and 72 for temporarily holding materials during rotation of the auxiliary flights 46 with the drum 12. The trailing edge portion 70 preferably has a radial length of about 2½ inches, the leading edge portion 72 a length of about ½ inch, and the medial portion 74 an inside transverse width of about 2 inches to define a cup 76 capable of holding ideal amounts of aggregate and of showering aggregate onto the flights 44 at an optimum rate. The radial gap between the outer radial end of the leading edge portion 72 and the outer surface of the medial portion 62 of the adjacent shielding flight 44 is similarly set to about 2½ inches to optimize showering.

4. Operation of Shielding Flights and Cooling Flights

In operation, aggregate is fed into the upper inlet 28 of the inner rotary drum 12 by conveyor 56 and is heated and dried as it travels downwardly through the drum 12 as described above. Aggregate in the lower end of the combustion zone 38 piles up along the dam 68 and is temporarily retained in this area at a level above the shielding flights 44 and is thus directly exposed to radiant heat from the flame 24. As the shielding flights 44 rotate through the aggregate, a portion of the aggregate is retained by the upstanding trailing edge portions 64 of the flights and is thus lifted to a discharge point located about 150° from the opposite end of the aggregate layer in the bottom of the drum. Thus, the aggregate is exposed to the radiant energy from the burner flame 24 through a substantial portion of drum rotation and thus is not substantially cooled in the combustion zone. The aggregate in the lower portion of the drum 12 also helps shield this portion of the drum shell 13 from heat from the burner 24.

Since the shielding flights 44 extend below the level of the aggregate in the bottom of the drum 12 and retain some of this aggregate through another portion of drum rotation, the flights 44 are shielded from exposure to radiant energy for a significant portion of the drum travel and thus self-coated. This cooling is, however, limited by the limited angle of rotation through which it occurs. Further cooling is provided by the cooling flights 46 which scoop up relatively small portions of aggregate as they traverse the lower portion of the drum 12 and retain this aggregate in their cups 76 while continuously showering the retained aggregate onto the outer radial surface of the medial edge portions 62 of the shielding flights 44. This showering continues through substantially the entire angle of rotation of the drum 12 in which shielding flight self-cooling does not occur and preferably begins at an angle of about 90° from bottom dead center (BDC) and continues through an angle of about 270° from BDC. The shielding flights 44 are cooled by contact with the showering aggregate during this time, and the cooling effect is enhanced by the fact that fresh aggregate continuously falls onto the trailing edges of the medial portions 62 of the flights 44 and cascades along the flights 44 before falling off either the trailing edges 64 (occurring during the early portion of the cooling cycle) or the leading edges 60 (occurring during the medial and latter portions of the cooling cycle). Shielding flight cooling is enhanced by the fact that the outwardly angled leading edges 60 of the shielding flights 44 retard cascading of the aggregate along the flights 44, at least during the medial and latter portions of the cooling cycle.

The cooling flights 46 provide distinct advantages not provided by the prior art cooling devices described above. Continuous showering on and cascading of fresh aggregate along the shielding flights 44 result in significantly enhanced cooling as compared to that achieved through the use of flights disclosed in the Butler patent in which essentially the same aggregate always remains in contact with the shielding flights throughout the cooling stage. These results are enhanced by using shielding flights 44 of the type described above which are to a limited extent self-cooled and by dimensioning the cooling flights 46 such that they cool the shielding flights 44 through substantially the entire angle of drum rotation in which the shielding flights 44 are not self-cooled. Moreover, since only relatively small amounts of aggregate are required for cooling with the remaining aggregate being exposed to radiant heat from the burner flame 24, the mean temperature of the aggregate in the drum 12 is not significantly reduced. Finally, since the relatively wide flights 44 prevent the showering of aggregate directly into the flame 24 from above, and since the outwardly angled leading edges 60 of the shielding flights 44 direct cascading aggregate toward the shell 13 of the drum 12 rather than toward the interior of the drum 12 during the medial and latter portions of the cooling cycle, flow of aggregate into the burner flame 24 is substantially inhibited or even prevented, thus inhibiting or preventing flame quenching. Maximum cooling is thus achieved using only a limited amount of aggregate while burner flame quenching is simultaneously inhibited.

Many changes and modifications could be made to the present invention without departing from the spirit thereof. For instance, as discussed above, the inventive cooling flights 46, though particularly useful with shielding flights 44 of the type described above, can be used with any conventional shielding flights. Moreover, the inventive cooling flights are not limited for use in asphalt drum mixers, but instead may be used in any counterflow or parallel flow rotary drum dryer having a combustion zone shielded by shielding flights. The scope of these and other changes will become apparent from a reading of the appended claims.

I claim:

1. A dryer comprising:

A. a rotary drum having a cylindrical shell;

B. a burner directing a flame generally axially into said drum to define a combustion zone therein; and C. a system of flights positioned in said combustion zone, said system of flights including 1. a plurality of relatively large shielding flights mounted around an inner periphery of said cylindrical shell; and 2. a plurality of relatively small cooling flights, said cooling flights being mounted around said inner periphery of said cylindrical shell radially between said shielding flights and said inner periphery of said cylindrical shell and being adapted to shower relatively small amounts of a material onto outer radial surfaces of adjacent shielding flights upon rotation of said drum to cool said shielding flights, wherein each of said shielding flights has a radially outwardly angled leading edge portion and a medial portion extending generally in parallel to an adjacent portion of said shell.

2. A dryer as defined in claim 1, wherein each of said shielding flights further comprises a radially inwardly angled trailing edge portion, said leading edge portion, medial portion, and trailing edge portion having transverse widths of 3 inches, 6 inches, and 3 inches, respectively.

3. A dryer as defined in claim 1, wherein each of said shielding flights additionally comprises a radial post connecting said medial portion to said shell.

4. A dryer as defined in claim 1, wherein each of said cooling flights has a leading edge positioned in general radial alignment with the medial portion of an adjacent one of said shielding flights.

5. A dryer as defined in claim 1, wherein each of said cooling flights is dimensioned so as to (1) define a cup for temporarily holding said material during rotation of said cooling flights with said drum and (2) shower said material onto an adjacent shielding flight through a designated angle of rotation.

6. A dryer as defined in claim 1, wherein each of said cooling flights has a relatively short leading radial edge portion, a relatively long trailing radial edge portion, and a medial portion connected to inner radial ends of said leading edge portion and said trailing edge portion, said medial portion extending generally in parallel to an adjacent portion of said shell.

7. A dryer as defined in claim 6, wherein said leading edge portion has a radial length of about ½ inch, said trailing edge portion has radial length of about 2½ inches, and said medial portion has an inner transverse width of about 2 inches.

8. A dryer as defined in claim 1, wherein said rotary drum is a counter flow type drum having an aggregate inlet located adjacent a first end thereof, an aggregate outlet located adjacent a second end thereof, and having said combustion zone located adjacent said second end.

9. A dryer as defined in claim 1, wherein said rotary drum is designed to heat and dry virgin aggregate, and further comprising a fixed sleeve encircling at least a portion of said cylindrical shell of said rotary drum to define a mixing chamber for the mixing of heated and dried virgin aggregate with other asphaltic products.

10. A method comprising:

A. directing a flame generally axially into a rotating drum to define a combustion zone therein;

B. heating and drying materials in said rotating drum using heat from said flame;

C. shielding a portion of a shell of said rotating drum which surrounds said combustion zone from heat from said flame, said shielding step comprising positioning shielding flights radially between said flame and said portion of said shell, said flights being attached to and rotating with said drum; and D. cooling said shielding flights, said cooling step comprising lifting relatively small amounts of said materials from materials accumulated in a lower portion of said drum and continuously showering lifted materials onto outer radial surfaces of said flights through a designated angle of drum rotation such that the showering materials cascade transversely across and off from said shielding flights.

11. A method as defined in claim 10, further comprising directing at least most of the cascaded materials back into said lower portion of said drum without contacting said flame.

12. A method as defined in claim 10, wherein said lifting and showering steps are performed by cooling flights attached to said drum radially between said shielding flights and said shell.

13. A method as defined in claim 12, where said lifting and showering steps are performed by said cooling flights each of which has a relatively short leading radial edge portion, a relatively long trailing radial edge portion, and a medial portion connected to inner radial ends of said leading edge portion and said trailing edge portion, said medial portion extending generally in parallel to an adjacent portion of said shell.

14. A method as defined in claim 10, wherein said showering step occurs through an angle beginning at approximately 90° after bottom dead center and terminating at approximately 270° after bottom dead center.

15. A method as defined in claim 10, wherein said cooling step further comprises immersing said shielding flights in said accumulated materials prior to said lifting and showering steps.

16. A method as defined in claim 10, wherein said heating and drying step comprises conveying said materials through said drum counter to the direction of said flame.

17. A method as defined in claim 16, wherein said materials comprise virgin aggregate, and further comprising discharging heated and dried virgin aggregate from said drum into a mixing chamber surrounding said drum and mixing said heated and dried virgin aggregate with other asphaltic products.

18. A method comprising:

A. directing a flame axially into a rotating drum to define a combustion zone therein;

B. heating and drying materials in said rotating drum using heat from said flame;

C. shielding a portion of a shell of said rotating drum which surrounds said combustion zone from heat from said flame, said shielding step comprising positioning shielding flights radially between said flame and said portion of said shell, said flights being attached to and rotating with said drum; and D. cooling said shielding flights, said cooling step comprising lifting said materials from materials accumulated in a lower portion of said drum and continuously showering lifted materials onto outer radial surfaces of said flights through at least about 180° angle of drum rotation such that the showering materials cascade transversely across and off from said shielding flights.

19. A method as defined in claim 18, further comprising immersing said shielding flights in said accumulated materials prior to said lifting step.

20. A dryer comprising:

A. a rotary drum having a cylindrical shell;

B. a burner directing a flame generally axially into said drum to define a combustion zone therein; and C. a system of flights positioned in said combustion zone, said system of flights including 1. a plurality of relatively large shielding flights mounted around an inner periphery of said cylindrical shell; and 2. a plurality of relatively small cooling flights, said cooling flights being mounted around said inner periphery of said cylindrical shell radially between said shielding flights and said inner periphery of said cylindrical shell and being adapted to shower relatively small amounts of a material onto an outer radial surface of an adjacent shielding flight upon rotation of said drum so as to cool said shielding flights, wherein each of said shielding flights has a medial portion extending generally parallel to an adjacent portion of said cylindrical shell.

* * * * *